US005746373A

United States Patent [19]

Sanada

[11] Patent Number: 5,746,373

[45] Date of Patent: May 5, 1998

[54] LIQUID INJECTION APPARATUS

[75] Inventor: Kazuo Sanada, Kanagawa, Japan

[73] Assignee: Fuji Photo Film Co., Ltd., Kanagawa, Japan

[21] Appl. No.: 604,469

[22] Filed: Feb. 21, 1996

[30] Foreign Application Priority Data

Feb. 22, 1996 [JP] Japan ..... 7-033552

[51] Int. Cl.[6] ..... B05B 1/08; B41J 2/045

[52] U.S. Cl. ..... 239/102.2; 347/68; 347/72

[58] Field of Search ..... 347/54, 68, 70, 347/71, 72, 95; 239/102.2

[56] References Cited

U.S. PATENT DOCUMENTS

| | | | |
|---|---|---|---|
| 4,533,082 | 8/1985 | Maehara et al. | 239/102.2 |
| 4,544,932 | 10/1985 | Barnett | 347/68 |
| 5,152,456 | 10/1992 | Ross et al. | 239/102.2 |
| 5,381,171 | 1/1995 | Hosono et al. | 347/72 |
| 5,581,286 | 12/1996 | Hayes et al. | 347/71 |

FOREIGN PATENT DOCUMENTS

| | | | |
|---|---|---|---|
| 491961 | 1/1992 | European Pat. Off. | 347/54 |
| 61-39861 | 9/1986 | Japan | B05B 17/06 |
| 33545 | 2/1990 | Japan | 239/102.2 |
| 5-181246 | 7/1993 | Japan | G03C 8/40 |
| 6-161070 | 6/1994 | Japan | G03C 8/40 |
| 6-242546 | 9/1994 | Japan | G03C 1/498 |
| 6-289555 | 10/1994 | Japan | G03C 8/40 |
| 9515822 | 6/1995 | WIPO | B05B 17/06 |

*Primary Examiner*—Andres Kashnikow
*Assistant Examiner*—Robin O. Evans
*Attorney, Agent, or Firm*—Sughrue, Mion, Zinn, Macpeak & Seas, PLLC

[57] ABSTRACT

A liquid injection apparatus uniformly applies a liquid on a material at one time in the form of a line. A nozzle plate is arranged on a portion opposing a photosensitive material of an injection tank. A plurality of nozzle holes are arranged in the nozzle plate in the form of a line. Thin elastic members are arranged between the upper portions of the side walls of the injection tank and the left and right ends of the nozzle plate which are end portions of the nozzle plate in the direction in which the nozzle holes are arranged in the form of a line. In addition, an elastic adhesive is applied to bury a gap between the side wall and the elastic member. Each of the upper and lower end portions of the nozzle plate is supported by the side wall and connected to one end portion of a lever plate. The other end portion of the lever plate is adhered to the upper surface of a piezoelectric element to connect the piezoelectric element to the lever plate.

20 Claims, 14 Drawing Sheets

LIQUID INJECTION APPARATUS

BACKGROUND OF THE INVENTION

1. Field of the Invention

The present invention relates to a liquid injection apparatus for applying a liquid on a material and, more particularly, to a liquid injection apparatus for applying an image forming solvent on an image recording material in the form of a line at one time.

2. Description of the Related Art

An image recording apparatus for performing an image recording process by using two types of image recording materials, e.g., a photosensitive material and an image receiving material is known.

The image recording apparatus of such a type has an image forming solvent coating unit for coating an image forming solvent on a photosensitive material, and a heat development/transfer unit constituted by a heating drum and an endless pressure-contact belt which is in pressure contact with the outer periphery of the heating drum and rotates together with the heating drum.

The photosensitive material on which an image is exposed while the photosensitive material is held and conveyed in the image recording apparatus is coated with water serving as an image forming solvent in the image forming solvent applying unit, and then sent into the heat development/transfer unit. The image-receiving material is sent into the heat development/transfer unit like the photosensitive material.

In the heat development/transfer unit, the photosensitive material coated with water is superposed on the image-receiving material. In this state, these materials are brought into tight contact with the outer periphery of the heating drum and wound therearound. In addition, while both the materials are held and conveyed between the heating drum and the endless pressure-contact belt, the photosensitive material is heat-developed, and the image is transferred to the image-receiving material, thereby allowing the predetermined image to form (to be recorded) on the image-receiving material.

For injecting a liquid such as water to apply it to a material, a conventional apparatus having the following arrangement (for example, described in Japanese Patent Application Publication No. 61-39861) is known. That is, an oscillator such as an electric oscillator is attached to a thin nozzle plate having nozzle holes, and nozzle plate is oscillated by the oscillator to cause a liquid to be ejected from the nozzle holes.

However, when the apparatus for applying a liquid to a material as described above is to be used as an applying device for coating an image forming solvent on a photosensitive material, the liquid must be uniformly applied on the photosensitive material in the form of a line at one time. For this reason, a plurality of nozzle holes arranged in a line must be employed, and all the plurality of nozzle holes arranged in a line must be simultaneously displaced by a single displacement.

In this case, for example, an injection apparatus 410 as shown in FIGS. 13 and 14 can be used. The injection apparatus 410 will be described below.

As shown in FIGS. 13 and 14, the injection apparatus 410 has a structure in which the four sides of a nozzle plate 412 having a plurality of nozzle holes 414 formed therein in the form of a line are adhered to one end side of a box-like tank body 416 to form a closed space for filling a liquid in the tank body 416.

More specifically, the injection apparatus 410 has a finite length as a matter of course, and has a structure in which the end portions of the nozzle plate 412 are confined to one end side of the tank body 416. As a result, the end portion of the nozzle plate 412 cannot be displaced and has a low degree of freedom. Therefore, since all the nozzle holes 414 arranged in a line cannot be uniformly displaced by a single displacement at once in the longitudinal direction of the nozzle holes 414, uniform application cannot be performed by the injection apparatus 410.

For this reason, the following structure may be used. A nozzle plate which is sufficiently long in a direction in which nozzle holes are arranged in the form of a line are used, the nozzle holes are formed in only an area in which oscillation is sufficiently uniform, and the nozzle holes are used for spraying. However, when such a structure is used, the apparatus increases in size, and so this apparatus cannot be practically used. As in the above description, it is difficult to inject a liquid uniformly in a direction in which the nozzle holes are arranged.

SUMMARY OF THE INVENTION

The present invention has been made in consideration of the above circumstances, and has as its object to provide a liquid injection apparatus in which displacement of a nozzle plate is made uniform in a direction in which nozzle holes are arranged, so that a liquid is uniformly applied on a material at one time in the form of a line.

According to the present invention, there is provided a liquid injection apparatus comprising:

- a pressure chamber in which a liquid is filled;
- a nozzle plate in which a plurality of nozzle holes for injecting the liquid are arranged;
- an actuator which displaces the nozzle plate to pressure the liquid in the pressurize chamber, thereby ejecting the liquid in the pressure chamber from the nozzle holes; and
- an elastic member which can be elastically deformed, being connected to an end portion of the nozzle plate in the direction in which the nozzle holes are arranged and to a wall portion of the pressure chamber, to be positioned between the end portion of the nozzle plate and the wall portion of the pressure chamber.

The nozzle plate is displaced by the actuator to pressurize the liquid in the pressure chamber, so that the liquid in the pressure chamber can be ejected from the nozzle holes.

The plurality of nozzle holes, arranged in the form of a line, for injecting a liquid are formed in the nozzle plate arranged in the pressure chamber as part of the wall portion of the pressure chamber, an elastic member which can be elastically deformed is connected to the other wall portion of the pressure chamber and an end portion of the nozzle plate in the direction in which the nozzle holes are arranged in the form of a line, and the elastic member is arranged between the end portion of the nozzle plate and the other wall portion of the pressure chamber.

Therefore, the end portion of the nozzle plate in the direction in which the nozzle holes are arranged is not directly coupled to the wall portion of the pressure chamber, but is coupled to the wall portion through the elastic member which can be elastically deformed. For this reason, the end portion of the nozzle plate in the direction in which the nozzle holes are arranged in the form of a line is not confined.

As a result, the nozzle holes arranged in the form of a line can be uniformly displaced at one time by a single displacement in the longitudinal direction of the nozzle holes, and the liquid can be uniformly applied to the material.

A liquid injection apparatus of the invention further comprises a displacement transmission member which has one end side connected to both side end portions of the nozzle to support the end portions in a direction perpendicular to a direction in which the plurality of nozzle holes are arranged;

wherein the actuator is arranged to be in contact with the other end side of the displacement transmission member, and displaces the nozzle plate connected to one end side of the displacement transmission member through the displacement transmission member. For this reason, through a displacement transmission member arranged to have the other end side which is in contact with the actuator, the actuator displaces the nozzle plate connected to one end side of the displacement transmission member to pressure the liquid in the pressure chamber, so that the liquid filled in the pressure chamber can be injected from the nozzle holes.

Therefore, the rigidity of a mechanism used when the displacement of the actuator is transmitted increases, reciprocal displacement of the nozzle plate can be performed only once, and a small amount of liquid can be injected at once in the form of a line.

One end side of the displacement transmission member having a width larger than that of the nozzle holes is connected to a portion of the nozzle in a direction perpendicular to the direction in which the plurality of nozzle holes are arranged in the form of a line, and the nozzle plate and the actuator are connected to each other through the displacement transmission member. For this reason, the nozzle holes arranged in the form of a line can be more uniformly, stably displaced at once by a single displacement, and the liquid can be uniformly coated.

DETAILED DESCRIPTION OF PREFERRED EMBODIMENTS

Figure 1:
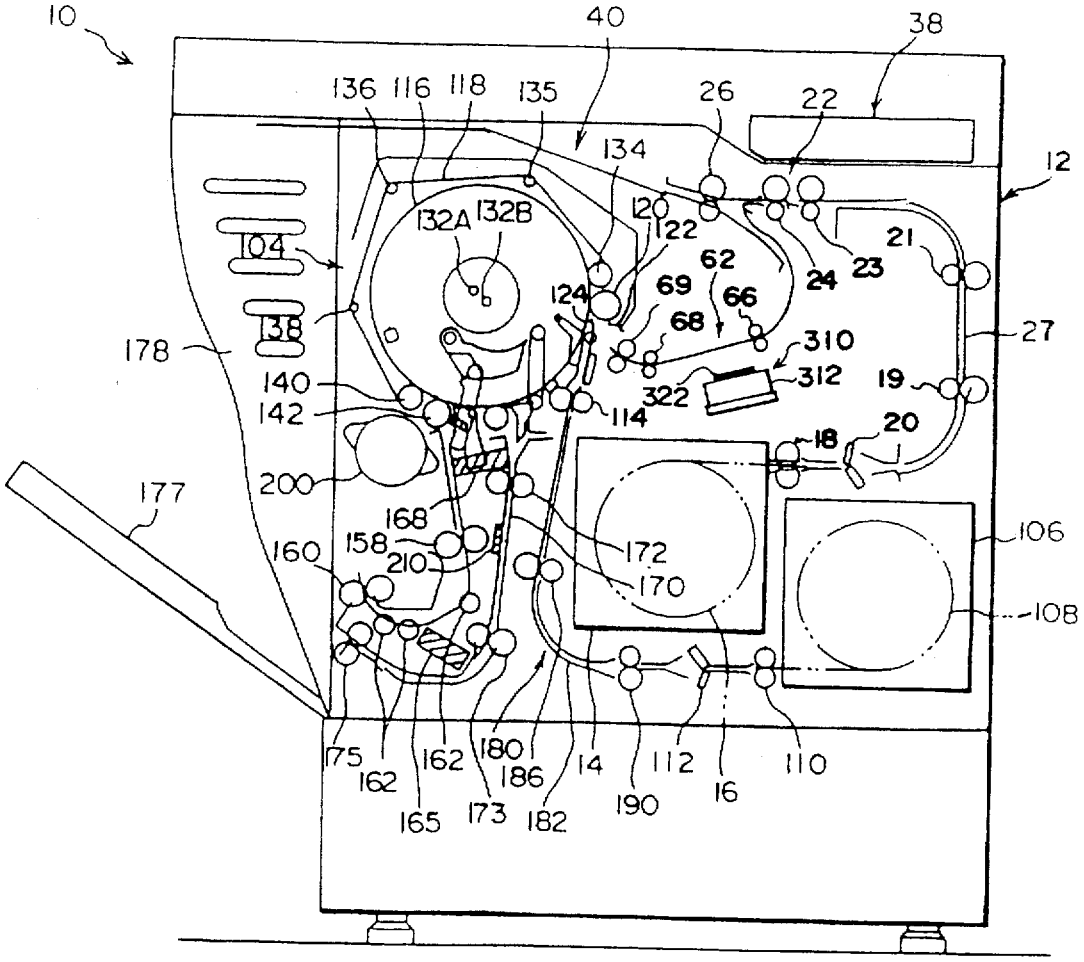
FIG. 1 is a schematic view of the entire arrangement of an image recording apparatus according to the first embodiment of the present invention.
Figure 2:
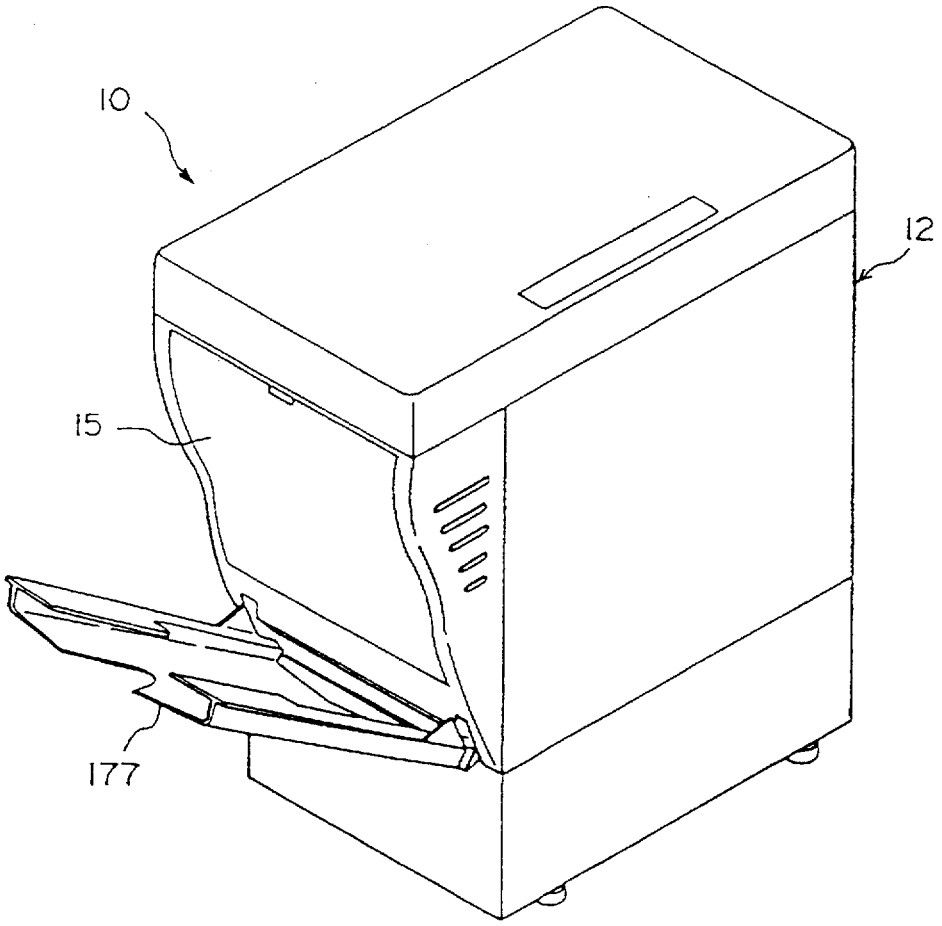
FIG. 2 is a sketch diagram of the image recording apparatus according to the first embodiment of the present invention.

FIG. 1 is a schematic view showing the entire arrangement of an image recording apparatus 10 according to the first embodiment of the present invention. FIG. 2 is a sketch diagram of the image recording apparatus 10.

A photosensitive material magazine 14 is arranged in a machine frame 12 of the image recording apparatus 10 shown in FIGS. 1 and 2. A photosensitive material 16 having a width-direction dimension of, e.g., 224 mm, is taken up and accommodated in the photosensitive material magazine 14.

In this case, as a photosensitive material used in the image recording apparatus of embodiment of the present invention, a so-called heat-developing photosensitive material which heat-develops/transfers a latent image obtained by performing image-like exposure to an image-receiving material in the presence of an image forming solvent so as to obtain a visible image is available.

This heat development/transfer material basically contains a photosensitive silver halide, a reducer, a binder, and a dye donative compound (may be replaced with a reducer) on a support member. The heat-developing photosensitive material may also contain an organic metal salt oxidant as needed.

A heat-developing photosensitive material which gives either of a negative image or a positive image may be used. For giving a positive image, either of a scheme directly using a positive emulsion (two types of schemes, i.e., a scheme using a nucleus-making agent or an optical fogging scheme) as a silver halide emulsion, or a scheme, using a dye donative compound, for dispersing a diffusive color image on a positive image can be employed.

As a heat-developing photosensitive material in the scheme for giving a positive image, for example, a material described in Japanese Patent Laid-Open Publication No. 6-161070, Japanese Patent Laid-Open Publication No. 6-289555, or the like can be used. As a heat-developing photosensitive material in the scheme for giving a negative image, for example, a material described in Japanese Patent Laid-Open Publication No. 5-181246, Japanese Patent Laid-Open Publication No. 6-242546, or the like can be used.

The photosensitive material 16 is taken up to have a photosensitive (exposure) surface which faces downward.

Nip rollers 18 and a cutter 20 are arranged near the photosensitive material takeout port of the photosensitive material magazine 14. The photosensitive material 16 can be cut after the photosensitive material 16 is drawn from the photosensitive material magazine 14 by a predetermined length. As the cutter 20, a rotary type cutter constituted by a fixed blade and a mobile blade is used. The mobile blade is vertically moved by a rotary cam or the like to be engaged with the fixed blade, thereby cutting the photosensitive material 16. Upon completion of the operation of the cutter 20, the nip rollers 18 are reversed, and the photosensitive material 16 is rewound until the leading end portion of the photosensitive material 16 is slightly nipped by the nip rollers 18.

A plurality of convey roller sets 19, 21, 23, 24, and 26 and a guide plate 27 are arranged in the side direction of the cutter 20, so that the photosensitive material 16 cut to have a predetermined length can be conveyed into an exposure unit 22.

The exposure unit 22 is arranged between the downstream convey roller set 23 and the upstream convey roller set 24 which are pairs of convey rollers, respectively, and has an exposure point between the convey roller set 23 and 24. The photosensitive material 16 passes the exposure point in such a manner that the photosensitive material 16 is held between the convey rollers 23 and 24. The convey rate (passing rate in the exposure unit 22) of the photosensitive material 16 conveyed by the convey rollers 23 and 24 is set to be, e.g., 12 mm/sec.

An exposure device 38 is arranged immediately above the exposure unit 22. Three types of LDs, a lens unit, a polygon mirror, and a mirror unit (all of them are not illustrated) are arranged in the exposure device 38.

A switch back unit 40 is arranged in the side direction of the exposure unit 22, and a coating device 310 for an image forming solvent is arranged below the exposure unit 22.

Although water is used as the image forming solvent in the present invention, this water is not limited to so-called distilled water, and popularly used water may be used. In addition, a solvent mixture of distilled water and a low-boiling point solvent such as methanol, DMF, aceton, or diisobutylketone may be used.

Furthermore, a solution containing an image forming accelerator, an anti-foggant, a development stopper, hydrophilic heat solvent, or the like may be used.

After the photosensitive material 16 which moves upward from the side of the photosensitive material magazine 14 and exposed by the exposure unit 22 is temporarily sent into the switch back unit 40, the photosensitive material 16 is sent into a water-applying unit 62 having the coating device 310 by reverse rotation of the pair of the convey rollers 26 through a convey path arranged below the exposure unit 22.

Figure 3:
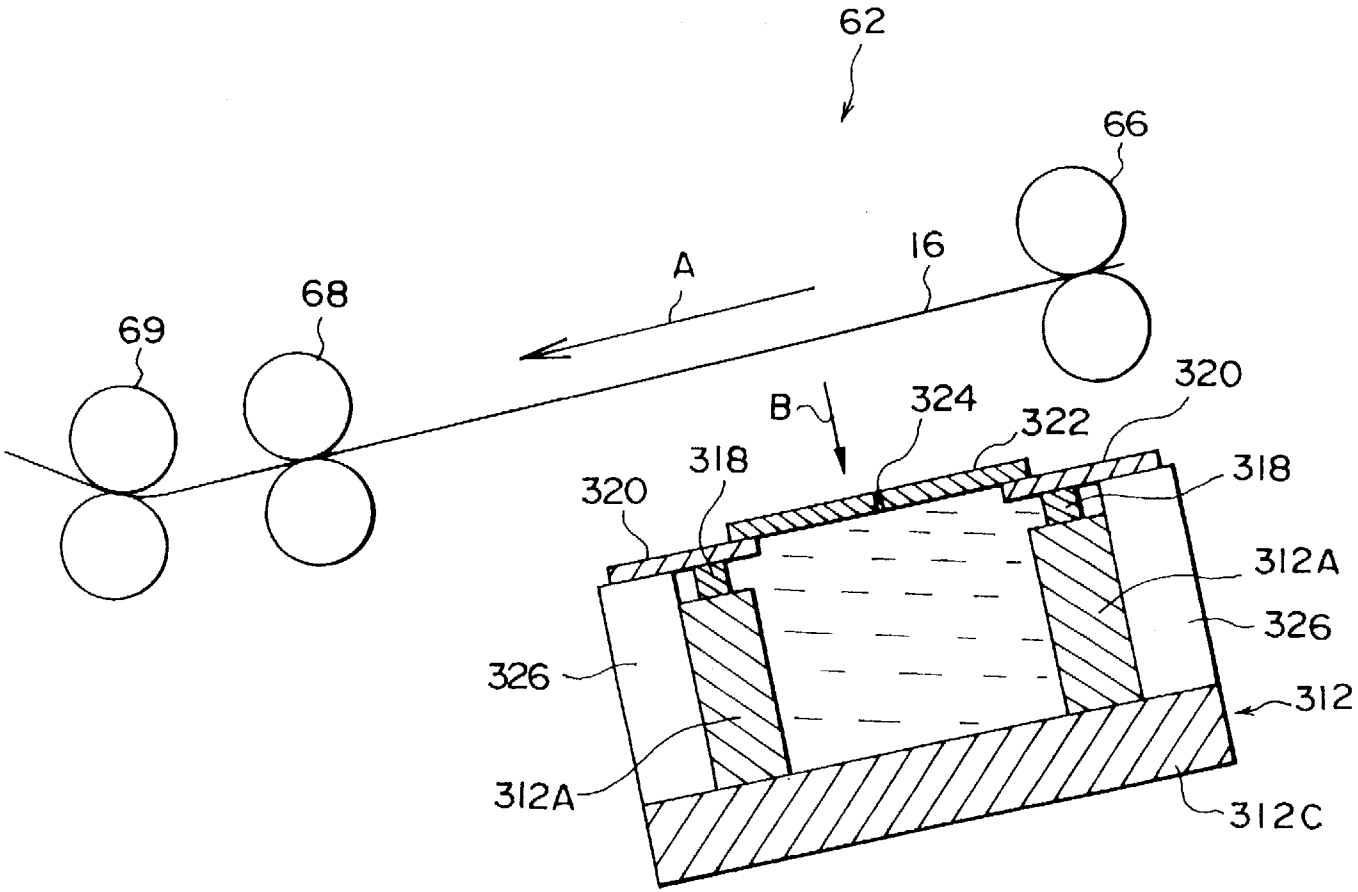
FIG. 3 is a schematic enlarged sectional view showing an injection tank according to the first embodiment of the present invention.

As shown in FIG. 3, an injection tank 312 serving as a pressure chamber partially constituting the coating device 310 serving as a liquid injection apparatus is arranged at a position opposing a convey path of the photosensitive material 16 of the water-coating unit 62. A pair of convey rollers 66 are arranged on the upstream side of the injection tank 312 in the convey direction of the photosensitive material 16. Two pairs of convey rollers 68 and 69 are arranged on the downstream side of the injection tank 312 in the convey direction of the photosensitive material 16.

Figure 4:
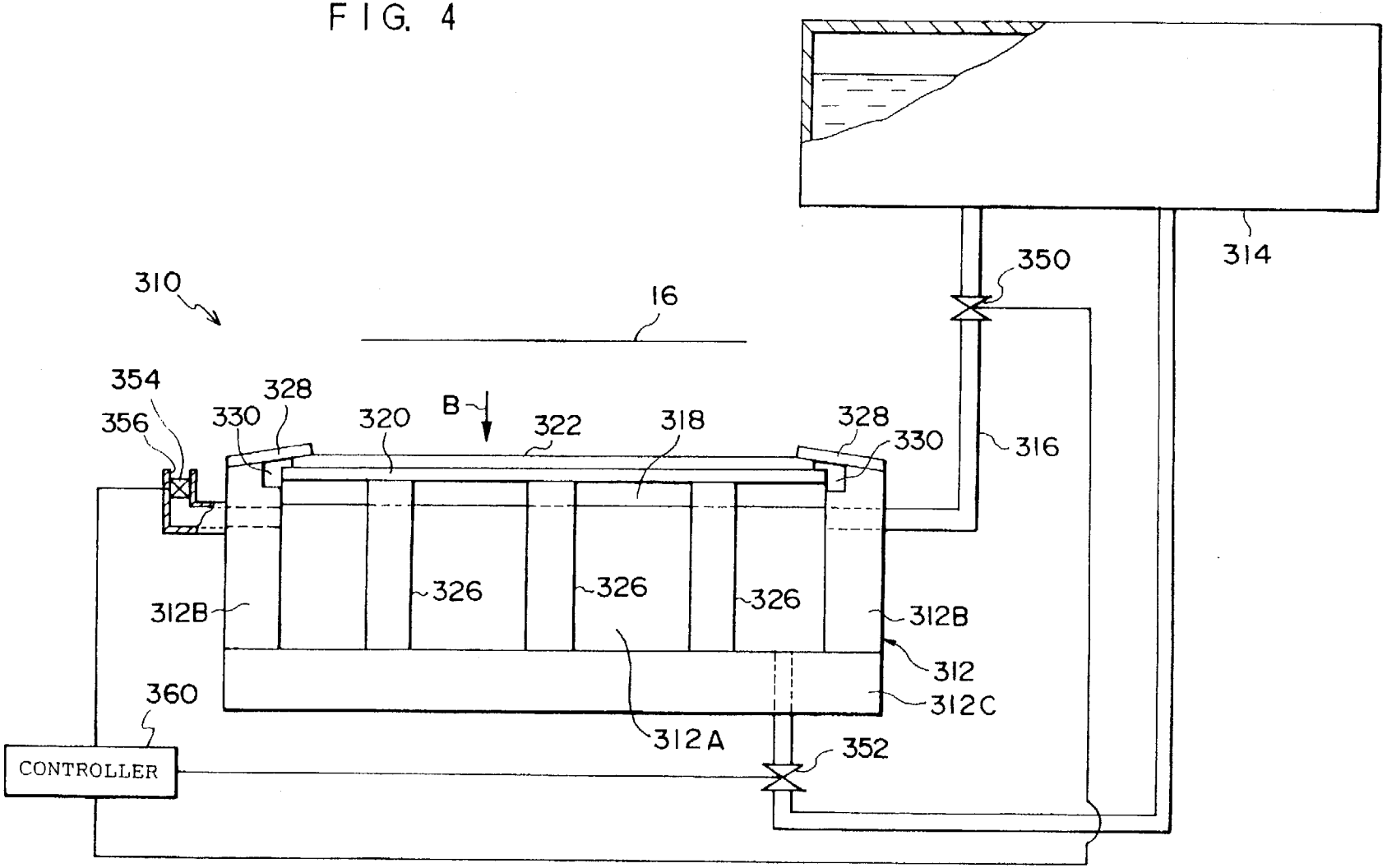
FIG. 4 is a schematic view showing the arrangement of an applying device according to the first embodiment of the present invention when viewed from a direction perpendicular to FIG. 3.

As shown in FIG. 4, a pool tank 314 for pooling water serving as an image forming solvent is arranged above the injection tank 312, and a pipe 316 having the injection tank 312 arranged on the way of the pipe 316 is connected to the lower side of the pool tank 314 to form a loop.

An upper valve 350 and a lower valve 352 are arranged at upper and lower positions with respect to the injection tank 312. The flow path in the pipe 316 can be opened/closed by the pair of valves 350 and 352. Water sent from the pool tank 314 by gravity through the pipe 316 fills the injection tank 312.

In addition, a nozzle plate 322 consisting of a rectangular thin plate which is elastically deformable is arranged on a portion which partially constitutes the wall surface of the injection tank 312 and opposes the convey path A of the photosensitive material 16.

Figure 5:
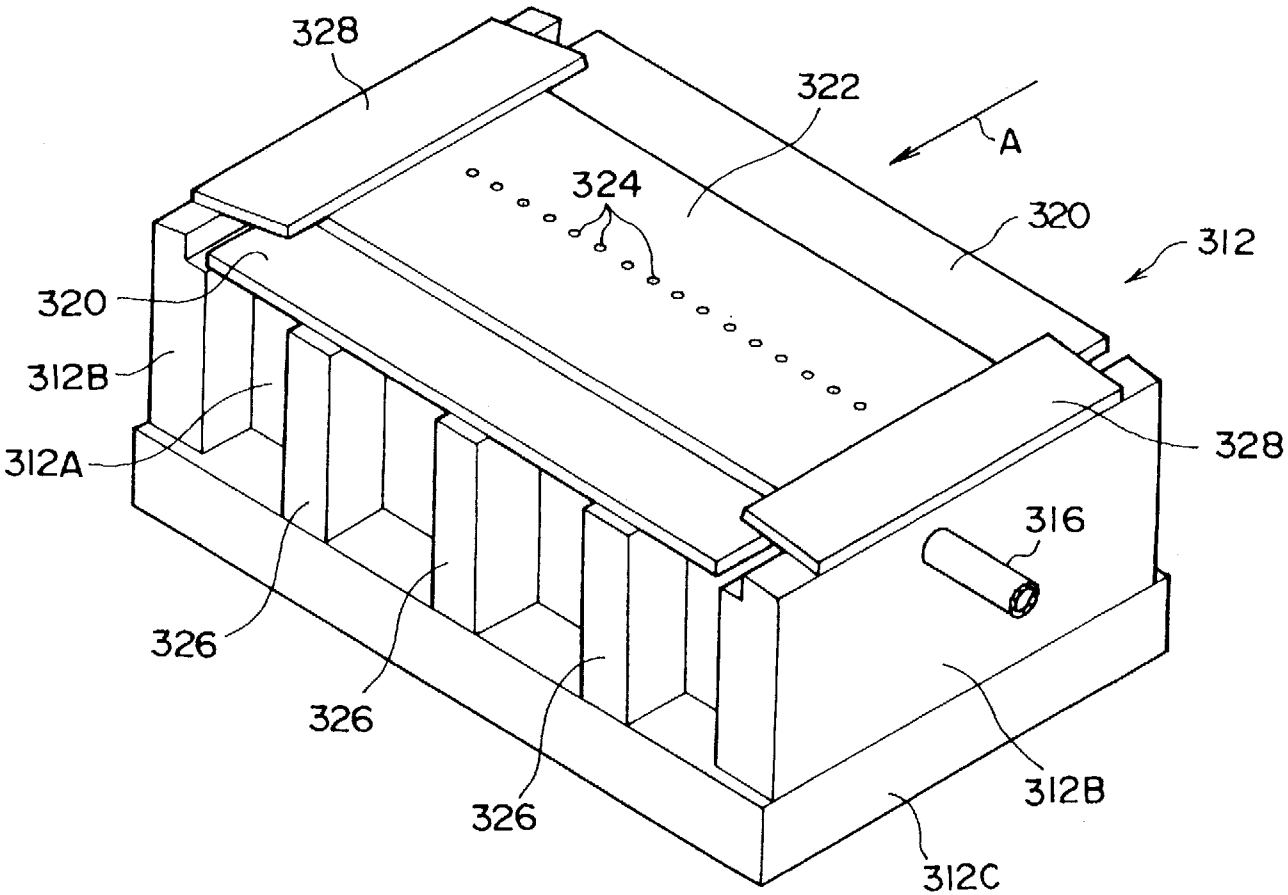
FIG. 5 is a perspective view showing the injection tank according to the first embodiment of the present invention.
Figure 6:
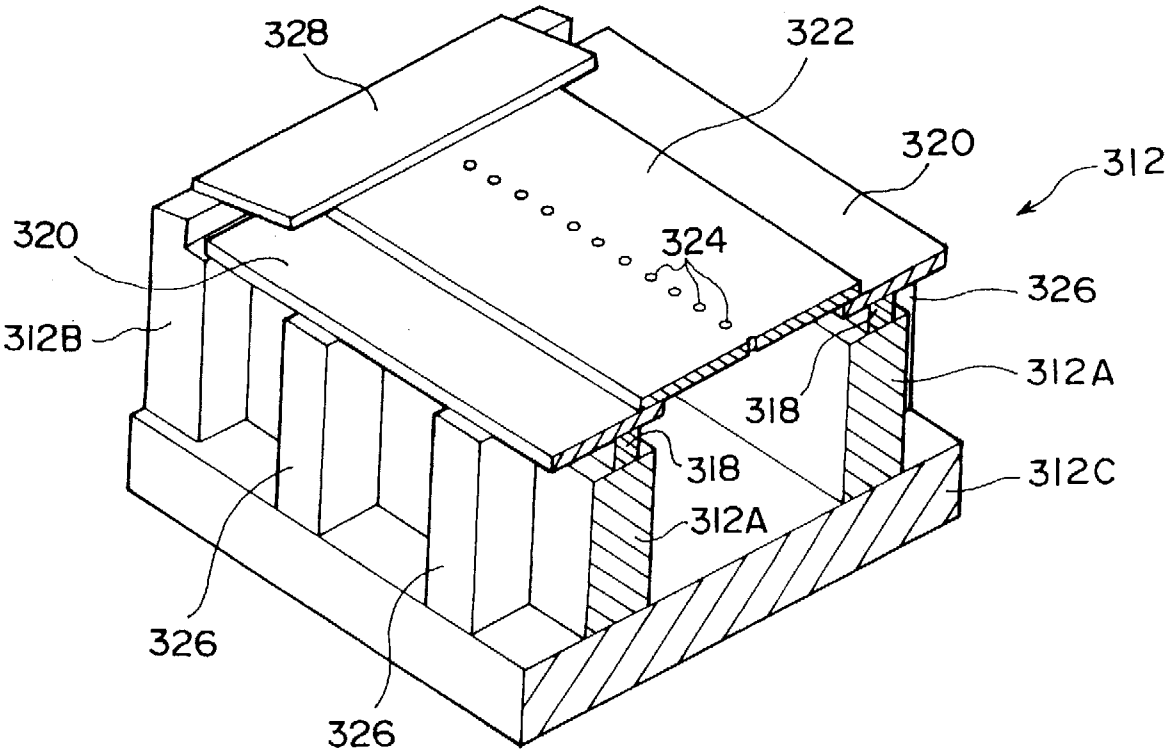
FIG. 6 is a perspective sectional view showing the injection tank according to the first embodiment of the present invention.

As shown in FIGS. 5 and 6, in the nozzle plate 322, a plurality of nozzle holes 324 (e.g., a diameter of several tens μm) for injecting water from the injection tank 312 are linearly arranged at predetermined intervals in the direction perpendicular to the convey direction of the photosensitive material 16. For this reason, the water in the injection tank 312 can be discharged from these nozzle holes 324.

As shown in FIG. 4, an opening 356 for causing the injection tank 312 to communicate with the outside of the injection tank 312 is formed at a position slightly below the nozzle holes 324 of the injection tank 312, and a tank valve 354 for opening/closing the opening 356 is arranged in the opening 356. By the opening/closing operation of the tank valve 354, the injection tank 312 can communicate with the atmospheric air. The upper valve 350, the lower valve 352, and the tank valve 354, as shown in FIG. 4, connected to a controller 360. The valves 350, 352, and 354 are controlled by the controller 360.

The upper and lower end portion of the nozzle plate 322 parallel to the longitudinal direction of the plurality of nozzle holes 324 are connected to one end portions of a pair of lever plates 320 serving as a displacement transmission member, respectively. The pair of lever plates 320 are fixed, through thin support members 318 arranged on the upper portions of a pair of side walls 312A of the injection tank 312, to the pair of side walls 312A, respectively.

A bottom wall 312C of the injection tank 312 extends outside the injection tank 312. A plurality of piezoelectric elements 326 (in this embodiment, three piezoelectric elements are arranged on each side) serving as actuators are arranged on the extended bottom wall 312C and adhered to the bottom wall 312C. The other end portions of the lever plates 320 are adhered to the upper surfaces of the piezoelectric elements 326, so that the piezoelectric elements 326 are connected to the lever plates 320.

Therefore, a lever mechanism is constituted by the piezoelectric elements 326, the lever plates 320, and support members 318. When the other end portion of the lever plate 320 is moved by the piezoelectric elements 326, one end portion of the lever plate 320 moves in a direction opposite to the motion of the other end portion. Note that each piezoelectric element 326 consists of multilayered piezoelectric ceramics, and has large displacement in the axial direction of the piezoelectric element 326. The piezoelectric element 326 is connected to a power supply (not shown) having a voltage apply timing which is controlled by the controller 360.

Elastic members 328 which consist of, e.g., a thin rubber film or membrane, and can be elastically deformed are arranged between the upper portions of side walls 312B of the injection tank 312 and the left and right ends of the nozzle plate 322 which are end portions of the nozzle plate 322 in the longitudinal direction of the nozzle holes 324 in such a manner that the elastic members 328 are adhered to the nozzle plate 322 and the side walls 312B.

An elastic adhesive 330 which is a silicon-rubber-based adhesive is filled to bury the gaps between the side walls 312B and the elastic members 328. For this reason, the gaps of the injection tank 312 are sealed with the elastic adhesive 330 without preventing the left and right ends of the nozzle plate 322 from moving.

Figure 7:
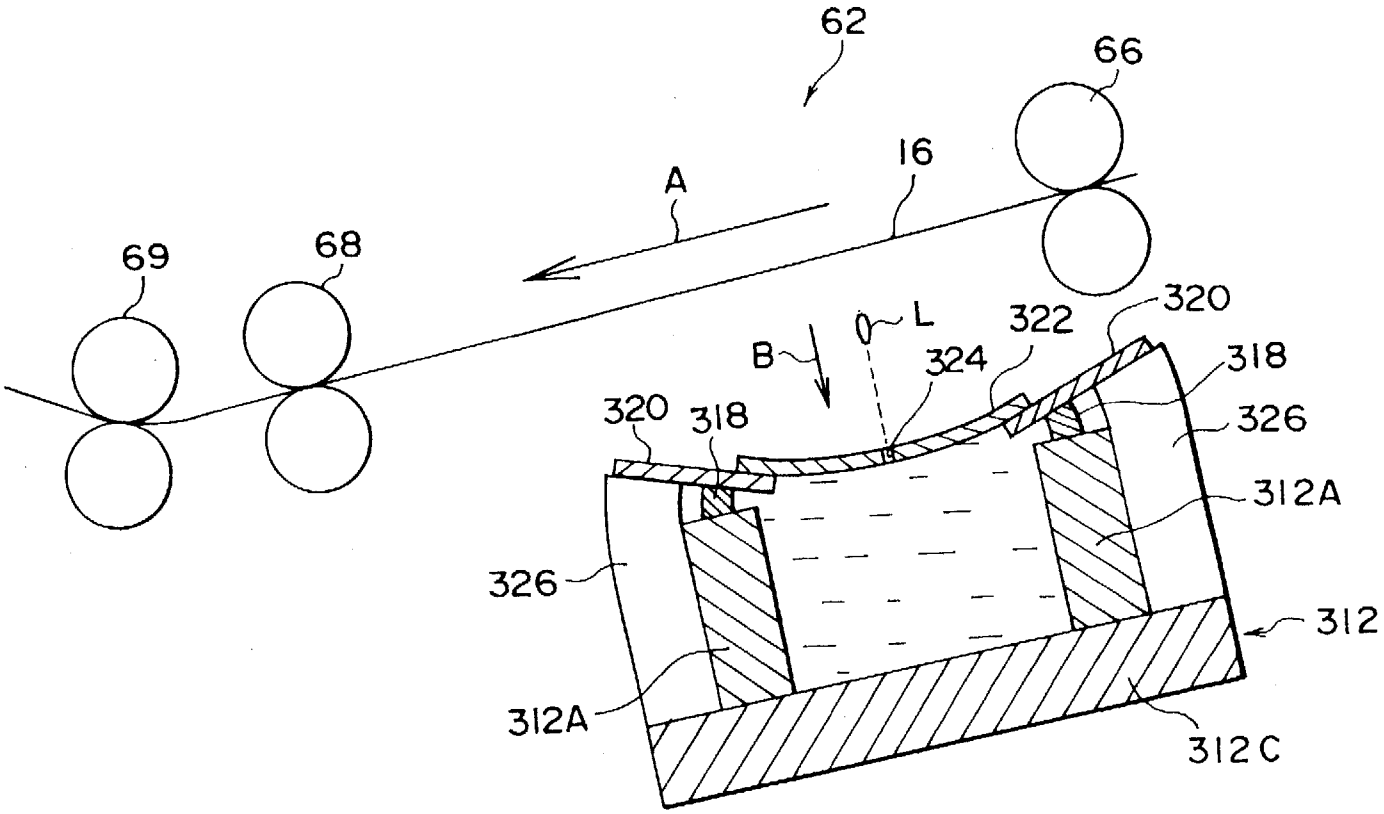
FIG. 7 is a schematic enlarged sectional view similar to FIG. 3 and showing the injection tank according to the first embodiment of the present invention.

As described above, when the piezoelectric elements 326 are rendered conductive by the power supply, as shown in FIG. 7, the piezoelectric elements 326 extend to pivot the lever plates 320 about support members 318. Accordingly, the piezoelectric elements 326 displace the nozzle plate 322 in such a manner that the nozzle plate 322 is moved downward in the direction of an arrow B. With the displacement of the nozzle plate 322, the pressure of the water in the injection tank 312 increases, and a small amount of water is linearly ejected from each of the nozzle holes 324 at once.

As shown in FIG. 1, an image-receiving material magazine 106 is arranged on the side direction of the photosensitive material magazine 14 in the machine frame 12, and an image-receiving material 108 is taken up in the form of a roll and accommodated in the image-receiving material magazine 106. A dye fixing material containing a mordant is coated on the image forming surface of the image-receiving material 108, the image-receiving material 108 is taken up in such a manner that the image forming surface faces above the apparatus.

A pair of nip rollers 110 is arranged near the image-receiving material takeout port of the image-receiving material magazine 106. The nip rollers 110 can draw the image-receiving material 108 from the image-receiving material magazine 106, and can release the nipping operation.

A cutter 112 is arranged in the side direction of the nip rollers 110. Like the cutter 20 for the photosensitive material, the cutter 112 is a rotary type cutter constituted by a fixed blade and a mobile blade. The mobile blade is vertically moved by a rotary cam or the like to be engaged with the fixed blade, thereby cutting the image-receiving material 108 drawn from the image-receiving material magazine 106 to a length shorter than that of the photosensitive material 16.

On the side direction of the cutter 112, the supply end portion of an image-receiving material convey unit 180 located on the side direction of the photosensitive material magazine 14 is arranged. Convey rollers 186, 190, and 114 and a guide plate 182 are arranged in the image-receiving material convey unit 180, so that the image-receiving material 108 cut to have a predetermined length can be conveyed into a heat development/transfer unit 104.

Figure 8:
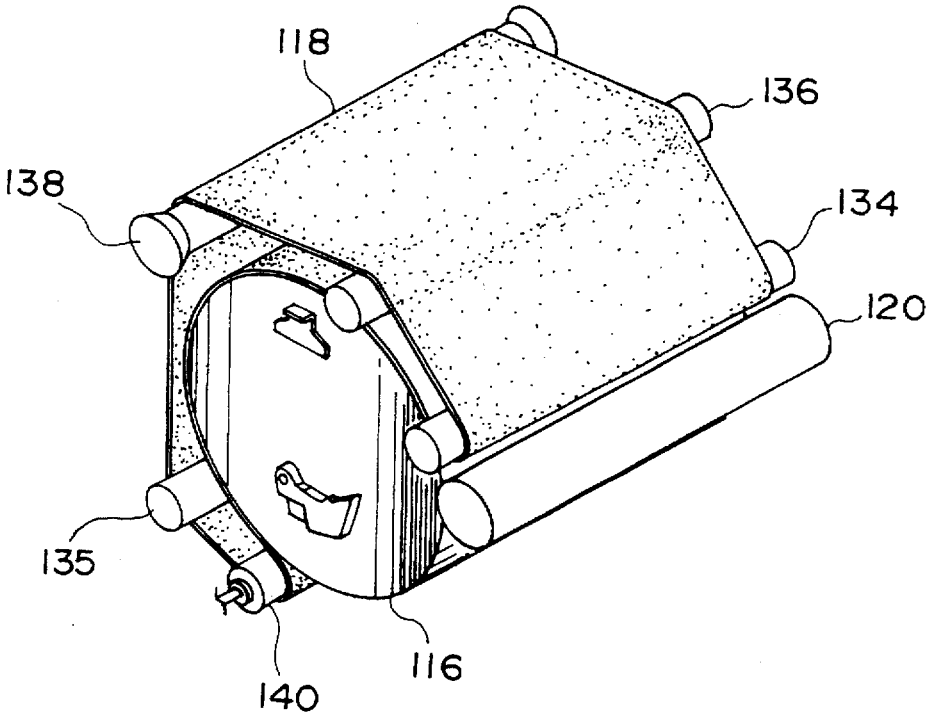
FIG. 8 is a perspective view showing a heating drum of a heat development/transfer unit.

As shown in FIG. 8, the heat development/transfer unit 104 is constituted by a heating drum 116 and an endless pressure-contact belt 118, and a superposing roller 120 is arranged on the outer periphery of the heating drum 116 on the water-applying unit 62 side.

On the convey path of the photosensitive material 16 between the superposing roller 120 and the convey rollers 69 of the water-applying unit 62, at a position opposing the rear surface (opposing the image forming surface) of the photosensitive material 16 sent from the convey rollers 69, a guide plate 122 is arranged to guide the photosensitive material 16 to the superposing roller 120.

This superposing roller 120 is connected to a drum motor 200 through a drive system (not shown). Drive force of the drum motor 200 is transmitted to the adhering roller 120 to rotate the superposing roller 120.

The photosensitive material 16 to be conveyed to the heat development/transfer unit 104 is sent between the superposing roller 120 and the heating drum 116. The image-receiving material 108 is conveyed in synchronism with a convey operation of the photosensitive material 16. In a state wherein the photosensitive material 16 is a predetermined length (in this embodiment, 20 mm) ahead of the image-receiving material 108, the photosensitive material 16 is sent between the superposing roller 120 and the heating drum 116 to be superposed with the image-receiving material 108. In this case, since the image-receiving material 108 has a width-direction dimension and a longitudinal-direction dimension which are smaller than those of the photosensitive material 16, the photosensitive material 16 is superposed with the image-receiving material 108 in such a manner that the four side portions of the photosensitive material 16 extend from the side portions of the image-receiving material 108.

A pair of halogen lamps 132A and 132B are arranged inside the heating drum 116. The halogen lamps 132A and 132B have output powers of 400 W and 450 W, respectively, so that the surface temperature of the heating drum 116 can be increased to heat the heating drum 116 to a predetermined temperature (e.g., about 82° C.). In this case, both the halogen lamps 132A and 132B are used at the start of heating, but only the halogen lamp 132A of the two halogen lamps is used in the subsequent ordinal operation.

The endless pressure-contact belt 118 is wound about five winding rollers 134, 135, 136, 138, and 140. The outer peripheral surfaces of the winding roller 134 and the winding roller 140 are in pressure contact with the outer periphery of the heating drum 116.

The winding roller 140 is connected to the drum motor 200 through a drive system (not shown). Drive force of the drum motor 200 is transmitted to the winding roller 140 to rotate the winding roller 140. When the winding roller 140 is rotated, the endless pressure-contact belt 118 wound around the winding roller 140 is rotated. Accordingly, the rotating force of the endless pressure-contact belt 118 is transmitted to the heating drum 116 by frictional force between the endless pressure-contact belt 118 and the heating drum 116 to rotate the heating drum 116.

Note that the drum motor 200 drives a plurality of drive units, i.e., the winding roller 140, the superposing roller 120, the convey rollers 68 and 69, a bending guide roller 142 (to be described later), photosensitive material exhaust rollers 158 and 160, and image-receiving material exhaust rollers 172, 173, and 175 together with each other.

The photosensitive material 16 and the image-receiving material 108 superposed on each other by the superposing roller 120 are held and conveyed between the heating drum 116 and the endless pressure-contact belt 118 over about ⅔ of the circumference (between the winding roller 134 and the winding roller 140) of the heating drum 116 while the photosensitive material 16 and the image-receiving material 108 are superposed on each other. In addition, when the photosensitive material 16 and the image-receiving material 108 which are superposed on each other are completely held between the heating drum 116 and the endless pressure-contact belt 118, rotation of the heating drum 116 is temporarily stopped (for example, 5 to 15 seconds), the photosensitive material 16 and the image-receiving material 108 which are held between the heating drum 116 and the endless pressure-contact belt 118 are heated. When the photosensitive material 16 is heated when the photosensitive material 16 is held and conveyed between the image-receiving material 108 and heating drum 116 and when the rotation of the heating drum 116 is stopped, the photosensitive material 16 discharges a mobile dye, and, at the same time, the dye is transferred to the dye fixing layer of the image-receiving material 108, thereby obtaining an image.

The bending guide roller 142 is arranged below the lower portion of the heating drum 116 and on the downstream side of a material supply direction with respect to the endless pressure-contact belt 118. The bending guide roller 142 is a rubber roller consisting of silicon rubber. Drive force of the drum motor 200 is transmitted to the bending guide roller 142 to rotate the bending guide roller 142. The bending guide roller 142 is brought into pressure contact with the outer periphery of the heating drum 116 at a predetermined pressure. The photosensitive material 16 and the image-receiving material 108 conveyed by the heating drum 116 and the endless pressure-contact belt 118 can be held and conveyed by the bending guide roller 142 and the heating drum 116.

A peeling claw or pawl (not shown) is arranged below the heating drum 116 and on the downstream side of a material supply direction with respect to the bending guide roller 142. This peeling claw is engaged with the leading end portion of the photosensitive material 16 among the photosensitive material 16 and the image-receiving material 108 which are held and conveyed between the endless pressure-contact belt 118 and the heating drum 116 to allow the leading end portion to be peeled from the outer periphery of the heating drum 116.

The photosensitive material exhaust rollers 158 and 160 and a plurality of guide rollers 162 are arranged below the bending guide roller 142 and the peeling claw. The photosensitive material 16 wound around the bending guide roller 142 and moved downward can be further conveyed by the photosensitive material exhaust rollers 158 and 160 and the guide rollers 162 to be stacked into a waste-photosensitive-material accommodating box 178. As described above, the drive force of the drum motor 200 for driving the heat development/transfer unit 104 is transmitted to the photosensitive material exhaust rollers 158 and 160 to rotate the photosensitive material exhaust rollers 158 and 160.

A drying fan 165 is arranged near the guide rollers 162 to hasten drying of the photosensitive material 16.

Referring to FIG. 1, an image-receiving material guide 170 and image-receiving material exhaust rollers 172, 173, and 175 are arranged below the heating drum 116 and on the right side of the bending guide roller 142. The image-receiving material guide 170 and the image-receiving material exhaust rollers 172, 173, and 175 guide and convey the image-receiving material 108 peeled from the heating drum 116 by a peeling claw (not shown) different from the above peeling claw.

A drum fan 168 is arranged below the heating drum 116. For this reason, the image-receiving material 108 which moves along the heating drum 116 is dried by not only heat of the heating drum 116 but also the drum fan 168. In addition, a ceramic heater 210 is arranged on the image-receiving material guide 170 to further hasten drying of the conveyed image-receiving material 108.

The image-receiving material 108 peeled from the outer periphery of the heating drum 116 by the peeling claw while the drying of the image-receiving material 108 is hastened by the drum fan 168 is conveyed by the image-receiving material guide 170 and the image-receiving material exhaust rollers 172, 173, and 175 to be exhausted into a tray 177.

A function of this embodiment will be described below.

In the image recording apparatus 10 having the above arrangement, after the photosensitive material magazine 14 is set, the nip rollers 18 operate to draw the photosensitive material 16. When the photosensitive material 16 is drawn by a predetermined length, the cutter 20 operates to cut the photosensitive material 16 to a predetermined length.

Upon completion of the operation of the cutter 20, the cut photosensitive material 16 is conveyed by the convey rollers 19, 21, 23, 24, and 26, and is reversed to cause the photosensitive (exposure) surface of the photosensitive material 16 to face upward. In this state, the photosensitive material 16 is conveyed into the exposure unit 22. When the photosensitive material 16 is nipped by the convey rollers 23, driving of the convey roller 23 is temporarily stopped, and the photosensitive material 16 is set in a standby state immediately before the exposure unit 22.

Driving of the convey rollers 23 and 24 is started, and the photosensitive material 16 passes through the exposure unit 22 at a predetermined rate. Simultaneously with conveying (passing through the exposure unit 22) of the photosensitive material 16, the exposure device 38 operates, and an image is scanned and exposed for the photosensitive material 16 located in the exposure unit 22.

Upon completion of exposure, the photosensitive material 16 after exposure is sent to the water-coating unit 62. In the water-coating unit 62, the conveyed photosensitive material 16 is sent to the injection tank 312 by the drive force of the convey roller 66, and is held and conveyed between the convey rollers 68 and 69.

Water injected from the injection tank 312 is adhered to the photosensitive material 16 conveyed along the convey path A. An operation and a function obtained at this time will be described below.

When the upper valve 350 and the lower valve 352 are opened by the controller 360, and the tank valve 354 is closed, water is supplied by gravity from the pool tank 314 into the injection tank 312 through the pipe 316 to fill the injection tank 312 with water.

When water is to be injected from the nozzle plate 322, the piezoelectric elements 326 are rendered conductive by the power supply controlled by the controller 360 to apply a voltage to the piezoelectric elements 326, and all the piezoelectric elements 326 are deformed in such a manner that the piezoelectric elements 326 are simultaneously extended.

When the piezoelectric elements 326 are deformed, the displacement is transmitted to the nozzle plate 322 through pivoting operations of the pair of lever plates 320 about support members 318, and the nozzle plate 322 are displaced such a manner that the nozzle plate 322 pressurizes water in the injection tank 312. As a result, the water in the injection tank 312 is ejected from the nozzle holes 324 as shown in FIG. 7, and applied to the photosensitive material 16 during the convey operation of the photosensitive material 16.

In this case, the plurality of nozzle holes 324 for injecting water arranged in the form of a line are formed in the nozzle plate 322 arranged on the injection tank 312 as part of the wall portion of the injection tank 312. In addition, the elastic members 328 which can be elastically deformed are connected to the end portions of the nozzle plate 322 in the longitudinal direction of the nozzle holes 324 and to the side walls 312B of the injection tank 312, and are arranged between the end portions of the nozzle plate 322 and the side walls 312B.

Therefore, the end portions of the nozzle plate 322 in the longitudinal direction of the nozzle holes 324 are not directly coupled to the side walls 312B of the injection tank 312, but coupled to the side walls 312B through the elastic members 328. For this reason, the end portions of the nozzle plate 322 in the longitudinal direction of the nozzle holes 324 are not confined, and can be freely moved.

As a result, without increasing the coating device 310 in size, the aligned nozzle holes 324 can be uniformly displaced at once by a single displacement in the longitudinal direction of the nozzle holes 324, and water can be uniformly coated.

One end portion of each lever plate 320 is connected to the end portion of the nozzle plate 322 parallel to the longitudinal direction of the nozzle holes 324. Therefore, unlike a case wherein the piezoelectric elements 326 are directly arranged on the nozzle plate 322, the rigidity of the mechanism used for transmitting displacement following deformation of the piezoelectric elements 326 increases, and reciprocal displacement of the nozzle plate 322 is performed only once. A small amount of water can be linearly injected onto the photosensitive material 16 at once.

One end portion of each lever plate 320 is connected to the end portion of the nozzle plate 322 parallel to the longitudinal direction of the nozzle holes 324, and the nozzle plate 322 is connected to the piezoelectric elements 326 through the lever plates 320. For this reason, the nozzle holes 324 can be further stably displaced simultaneously by a single displacement in the perpendicular direction of the aligned nozzle holes 324, and water can be uniformly coated on the photosensitive material 16.

When water is injected from the nozzle holes 324 many times at a predetermined timing in accordance with the convey rate of the photosensitive material 16, the water is applied onto the entire surface of the photosensitive material 16. According to this embodiment, since the nozzle holes 324 are formed in the form of a line in the direction perpendicular to the convey direction of the photosensitive material 16, when the nozzle plate 322 is displaced by the piezoelectric elements 326 once, water can be applied to the photosensitive material 16 with a wide range.

When water is ejected from the nozzle holes 324 of the nozzle plate 322, water in the injection tank 312 gradually decreases in volume. When the upper valve 350 and the lower valve 352 are periodically opened by control by the controller 360, and the tank valve 354 is periodically closed by control by the controller 360, water is supplied from the pool tank 314 by gravity. Therefore, continuous injection of water can be.

Thereafter, the photosensitive material 16 applied with water serving as an image forming solvent by the water-applying unit 62 is sent to the heat development/transfer unit 104 by the convey rollers 68 and 69.

With the start of scanning and exposure for the photosensitive material 16, the image-receiving material 108 is also drawn from the image-receiving material magazine 106 by the nip roller 110 and conveyed. When the image-receiving material 108 is drawn by a predetermined length, the cutter 112 operates to cut the image-receiving material 108 having the predetermined length.

Upon completion of the operation of the cutter 112, the cut image-receiving material 108 is conveyed by the convey roller 190, 186, and 114 while the image-receiving material 108 is guided by the guide plate 182 of the image-receiving material convey unit 180. When the leading end portion of the image-receiving material 108 is held by the convey rollers 114, the image-receiving material 108 is set in a standby state immediately before the heat development/transfer unit 104.

In the heat development/transfer unit 104, when it is detected that the photosensitive material 16 is sent by the convey rollers 68 and 69 into a portion between the outer periphery of the heating drum 116 and the superposing roller 120, a convey operation of the image-receiving material 108 is restarted to send the image-receiving material 108 to the superposing roller 120, and the heating drum 116 is operated.

Thereafter, when the photosensitive material 16 and the image-receiving material 108 are held and conveyed to reach the lower portion of the heating drum 116, the peeling claw operates to be engaged with the leading end portion of the photosensitive material 16 conveyed a predetermined length ahead of the image-receiving material 108 first, the leading end portion of the photosensitive material 16 is peeled from the outer periphery of the heating drum 116 and wound around the bending guide roller 142. The photosensitive material 16 wound around the bending guide roller 142 is further conveyed by the photosensitive material exhaust rollers 158 and 160 while the photosensitive material 16 is guided by the guide rollers 162. At this time, the photosensitive material 16 is dried by the drying fan 165, and is stacked in the waste-photosensitive-material accommodating box 178.

The image-receiving material 108 separated from the photosensitive material 16 is conveyed by the image-receiving material exhaust rollers 172, 173, and 175 while the photosensitive material 16 is guided by the image-receiving material guide 170. At this time, the image-receiving material 108 is exhausted into the tray 177 while the image-receiving material 108 is dried by the drum fan 168 and the ceramic heater 210.

When a plurality of images are subjected to a recording process, the following steps are sequentially performed.

After the image-receiving material 108 which is wound around the heating drum 116 and subjected to a heat development/transfer process and on which a predetermined image is formed (recorded) as described above is peeled from the heating drum 116, drying of the image-receiving material 108 is hastened by drying means such as the drum fan 168 and the ceramic heater 210, the image-receiving material 108 is held and conveyed by the plurality of image-receiving material exhaust rollers 172, 173, and 175 and taken out from the apparatus.

The above image recording apparatus 10 to which the second embodiment of the liquid injection apparatus of the present invention is applied in the same manner as described above is shown in FIGS. 9 to 12. The second embodiment will be described below with reference to FIGS. 9 to 12. The same reference numerals as in the first embodiment denote the same members in the second embodiment, and a description thereof will be omitted.

Figure 9:
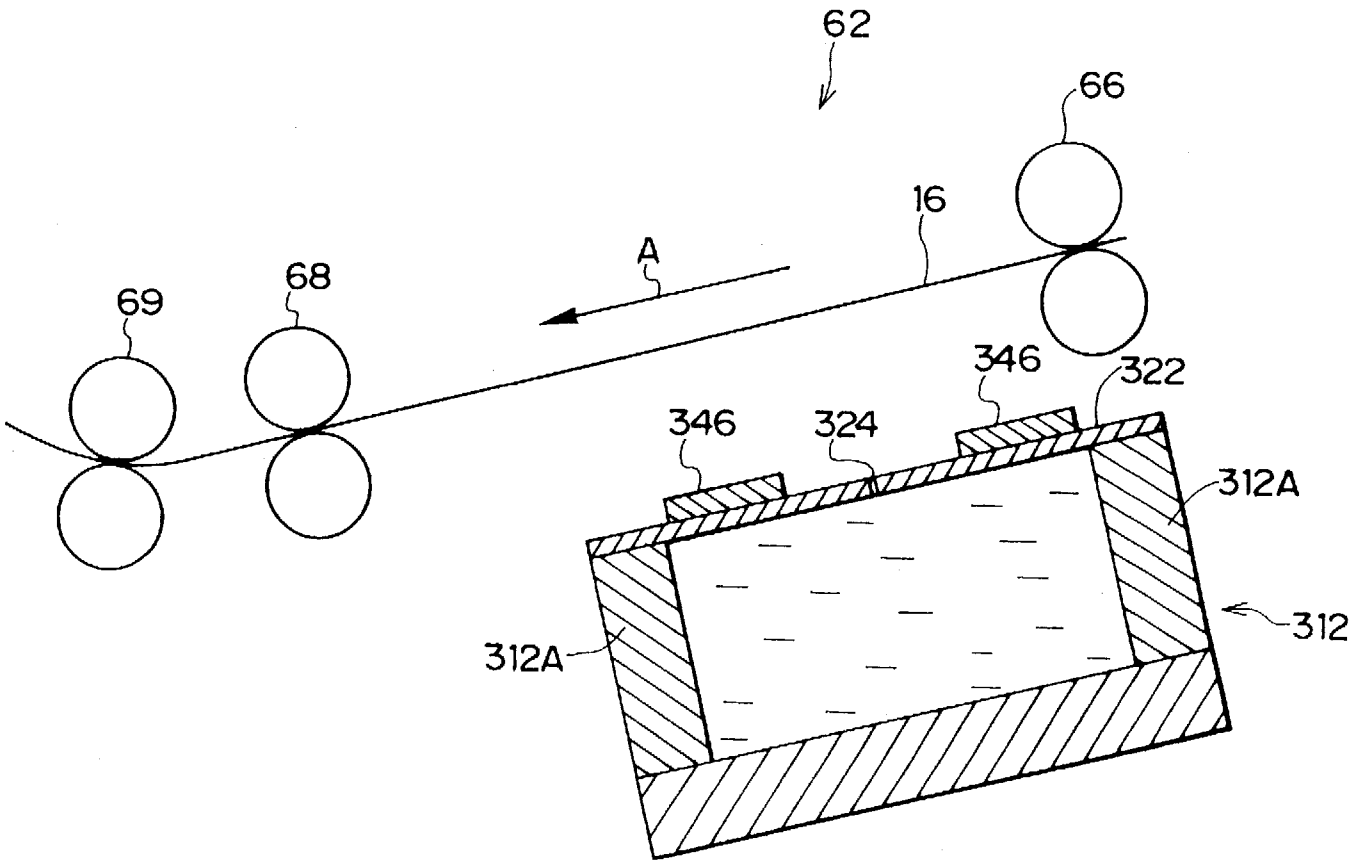
FIG. 9 is a schematic enlarged sectional view showing an injection tank according to the second embodiment of the present invention.

As shown in FIG. 9, an injection tank 312 serving as a pressure chamber partially constituting an applying device 310 serving as a liquid injection apparatus is arranged at a position opposing a convey path A of a photosensitive material 16 of the water-applying unit 62.

In addition, a nozzle plate 322 consisting of a rectangular thin plate which can be elastically deformed is arranged on a portion which partially constitutes the wall surface of the injection tank 312 and opposes the convey path A of the photosensitive material 16. The upper and lower end portions of the nozzle plate 322 are arranged to be respectively adhered to the upper portions of a pair of side walls 312A of the injection tank 312.

Figure 10:
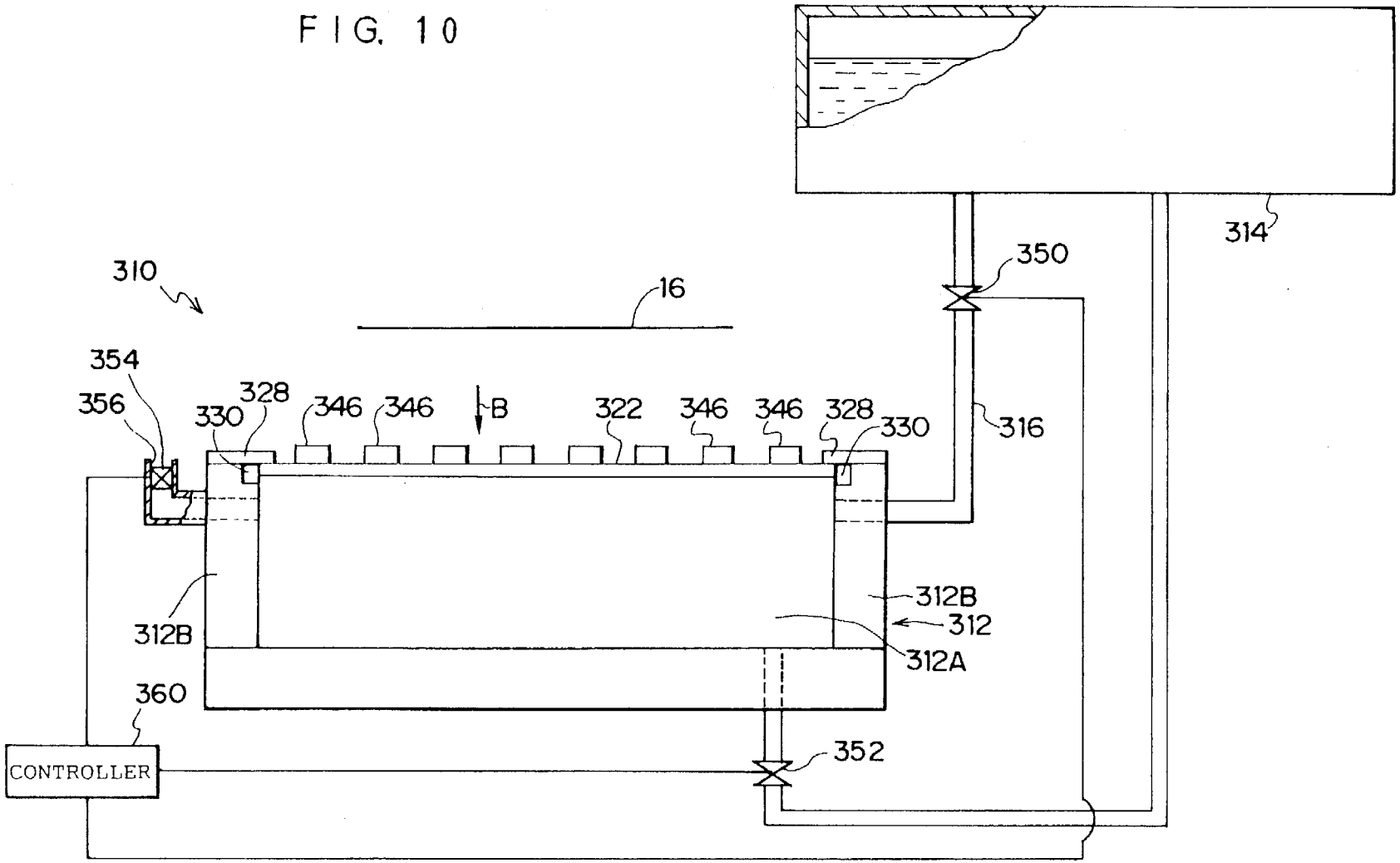
FIG. 10 is a schematic view showing the arrangement of an applying device according to the second embodiment of the present invention when viewed from a direction perpendicular to FIG. 9.
Figure 11:
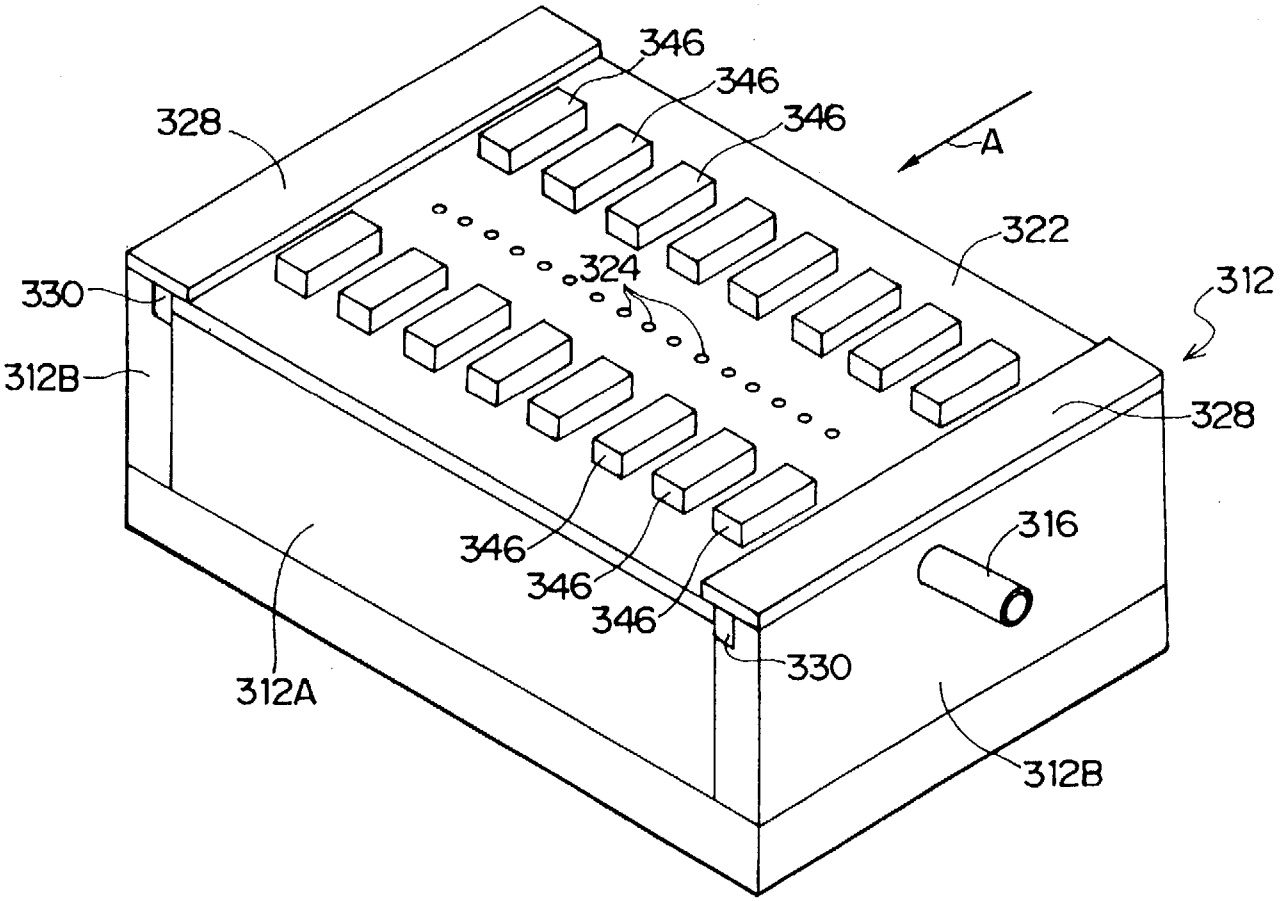
FIG. 11 is a perspective view showing the injection tank according to the second embodiment of the present invention.

As shown in FIGS. 10 and 11, a plurality of piezoelectric elements 346 (in this embodiment, eight piezoelectric elements are arranged on each side) serving as oscillators are adhered to the nozzle plate 322 in a direction perpendicular to a direction in which nozzle holes 324 are arranged in the form of a line, i.e., on the nozzle plate 322 on both the sides of the line on which the plurality of nozzle holes 324 are arranged. Each piezoelectric element 346 is a rectangular parallelpiped, and is arranged to have a longitudinal direction crossing (in this embodiment, perpendicular to) the direction in which the nozzle holes 324 are arranged in the form of a line.

Note that each piezoelectric element 346 consists of multilayered piezoelectric ceramics, and is connected to a power supply (not shown) having a voltage apply timing which is controlled by a controller (not shown).

Elastic members 328 which consist of, for example, a thin rubber membrane and can be elastically deformed are arranged between the upper portions of side walls 312B of the injection tank 312 and the left and right ends of the nozzle plate 322 which are end portions of the nozzle plate 322 in the longitudinal direction of the arrangement of the plurality of nozzle holes 324 in such a manner that the elastic members 328 are connected to the nozzle plate 322 and the side walls 312B.

An elastic adhesive 330 is filled to bury the gaps between the side walls 312B and the elastic members 328. The gaps of the injection tank 312 are sealed with the elastic adhesive 330 without preventing the left and right ends of the nozzle plate 322 from moving.

As described above, the piezoelectric elements 346 are rendered conductive by the power supply controlled by the controller to apply a voltage to the piezoelectric elements 346, and all the piezoelectric elements 346 are deformed in such a manner that the piezoelectric elements 346 are simultaneously extended.

Figure 12:
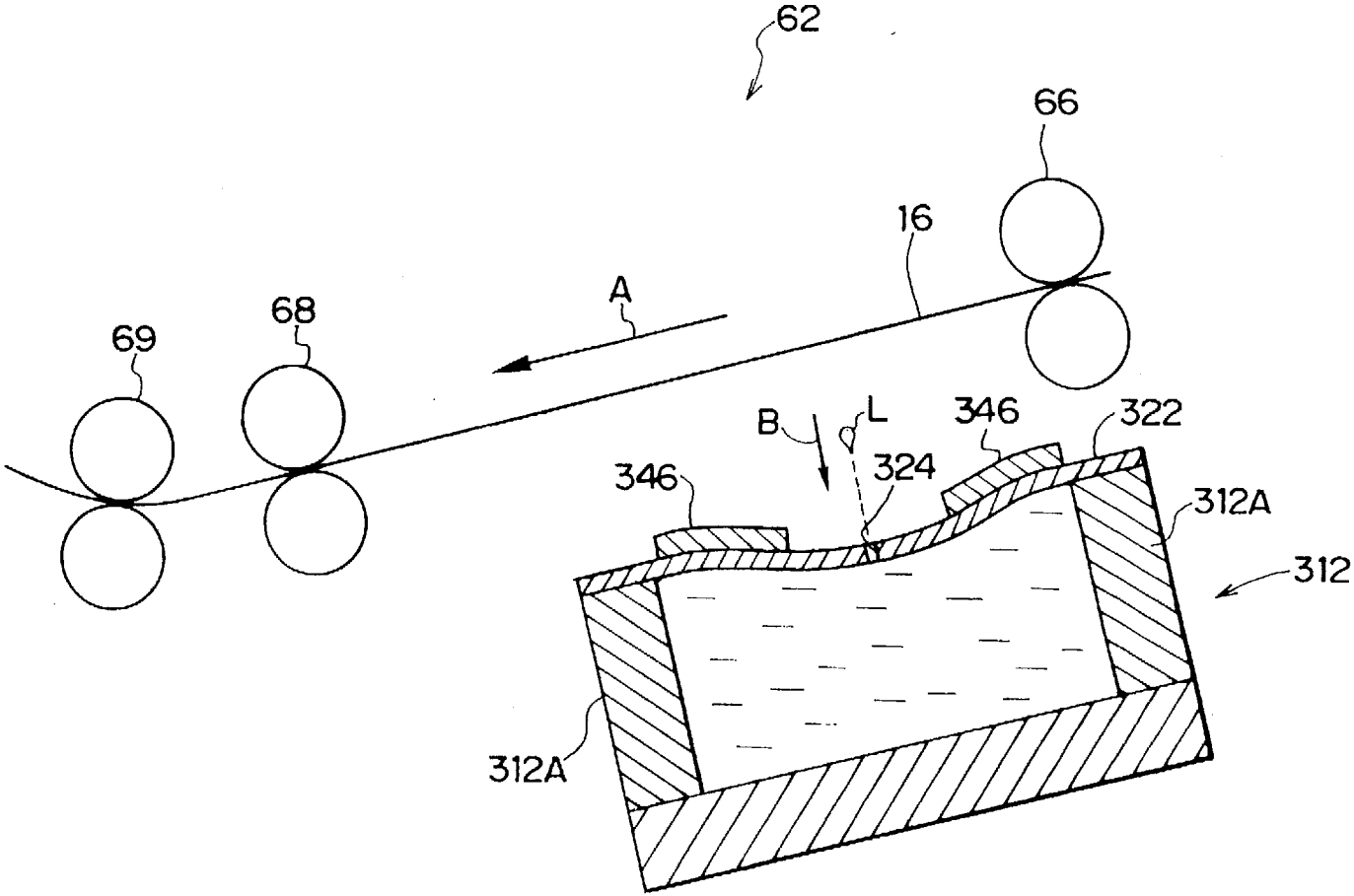
FIG. 12 is a schematic enlarged sectional view similar to FIG. 9 and showing the injection tank according to the second embodiment of the present invention, and shows state wherein water in the injection tank is pressured.
Figure 13:
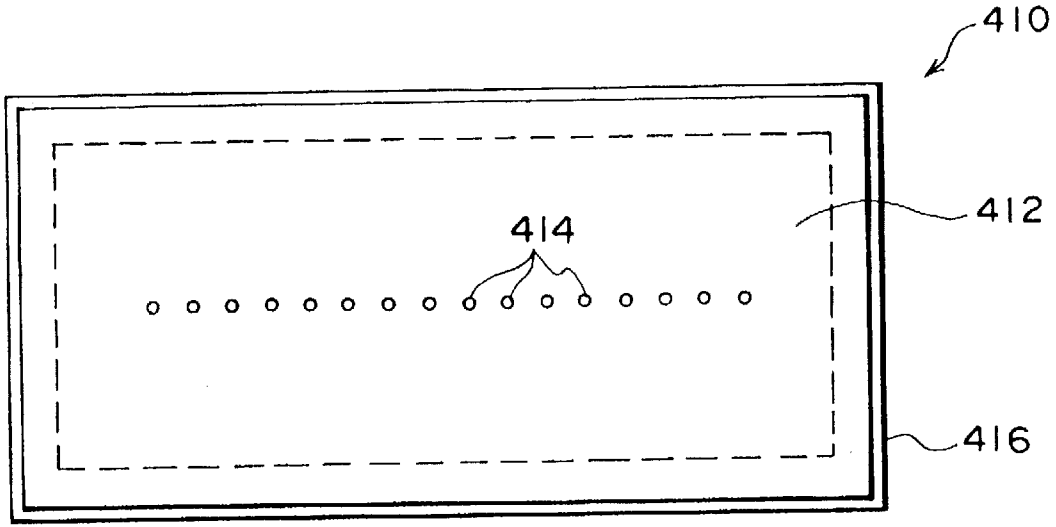
FIG. 13 PRIOR ART
FIG. 13 is a plan view showing a conventional injection apparatus.
Figure 14:
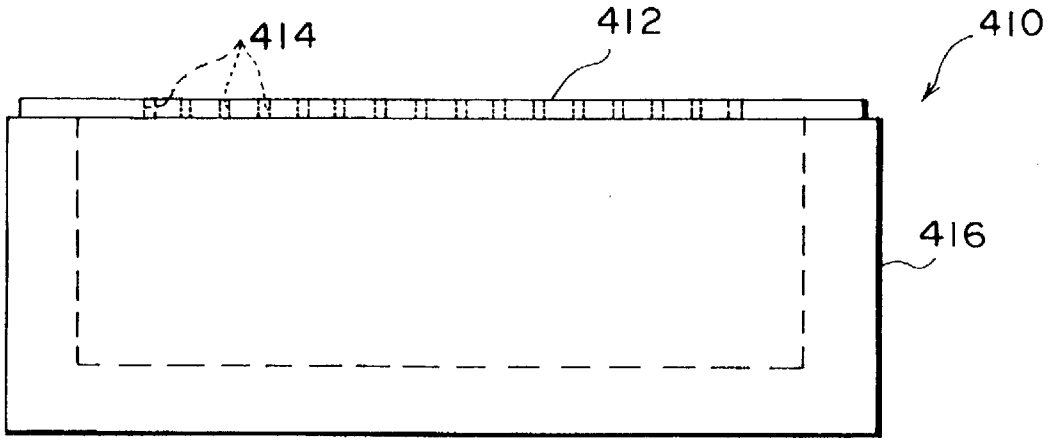
FIG. 14 PRIOR ART
FIG. 14 is a side view showing a conventional injection apparatus.

When the plurality of piezoelectric elements 346 simultaneously extend as described above, the nozzle plate 322 is deformed to pressurize the water in the injection tank 312 in such a manner that the central portion of the nozzle plate 322 is displaced to move downward in the direction of an arrow B in FIG. 12 like a bimetal plate. As a result, the pressure of the water in the injection tank 312 increases. Therefore, as shown in FIG. 12, a small amount of water L can be uniformly, linearly ejected from the nozzle holes 324 at once, and the water L can adhere to the photosensitive material 16 during the convey operation of the photosensitive material 16.

At this time, as in the first embodiment, since the end portions of the nozzle plate 322 in the longitudinal direction of the arrangement of the plurality of nozzle holes 324, as shown in FIGS. 10 and 11, are coupled to the side walls 312B through the elastic members 328 which can be elastically deformed, the end portions of the nozzle plate 322 in the longitudinal direction of the arrangement of the plurality of nozzle holes 324 are not confined. Therefore, as in the first embodiment, without increasing the coating device 310 in size, the aligned nozzle holes 324 can be uniformly displaced at once by a single displacement in the longitudinal direction of the nozzle holes 324.

In addition, unlike a case wherein a long piezoelectric element is simply arranged on the nozzle plate 322 in the longitudinal direction of the nozzle holes 324 arranged in the form of a line, each piezoelectric element 346 is arranged to have a longitudinal direction crossing the longitudinal direction of the arrangement of the nozzle holes 324. For this reason, the nozzle plate 322 can be displaced by a large displacement in the direction of the arrow B which is a direction perpendicular to the plane on which the nozzle plate 322 is formed. Since the plurality of piezoelectric elements 346 are arranged on the nozzle plate 322 with a range wider than that of the nozzle holes 324, the nozzle holes 324 can be further stably displaced at once by a single displacement in the perpendicular direction of the aligned nozzle holes 324, and water can be further uniformly, linearly applied to the photosensitive material 16 at once.

In this embodiment, the pool tank 314 is arranged above the injection tank 312. However, the pool tank 314 may be arranged below the injection tank 312, and water may be drawn up by a pump.

This embodiment has been described by using the image recording apparatus 10 having the photosensitive material 16 and the image-receiving material 108 as image recording materials. The present invention can be applied to an image recording apparatus having only a photosensitive material. Furthermore, the present invention can be applied to an image recording apparatus which does not use these materials but uses a sheet-like or roll-like image recording material.

What is claimed is:

1. A liquid injection apparatus comprising:

a pressure chamber in which a liquid is filled;

a nozzle plate in which a plurality of nozzle holes for injecting the liquid are arranged;

an actuator which displaces said nozzle plate to pressurize the liquid in said pressure chamber, thereby forcing the liquid in said pressure chamber from said nozzle holes; and an elastically deformable elastic member connected to an end portion of said nozzle plate in the direction in which said nozzle holes are arranged and to a wall portion of said pressure chamber disposed between the end portion of said nozzle plate and the wall portion of said pressure chamber.

2. A liquid injection apparatus according to claim 1, wherein said nozzle plate is arranged on said pressure chamber as part of a wall surface of said pressure chamber.

3. A liquid injection apparatus according to claim 2, wherein said nozzle plate forms an upper surface of said pressure chamber.

4. A liquid injection apparatus according to claim 2, wherein said nozzle plate consists of a rectangular thin plate.

5. A liquid injection apparatus according to claim 4, wherein said nozzle holes are arranged on a central axis in a longitudinal direction of said nozzle plate.

6. A liquid injection apparatus according to claim 1, wherein said nozzle holes are arranged in the form of a straight line.

7. A liquid injection apparatus according to claim 1, wherein said nozzle plate can be elastically deformed.

8. A liquid injection apparatus comprising:

a pressure chamber fillable with a liquid;

a nozzle plate, which is arranged on said pressure chamber as a part of a wall surface of said pressure chamber and in which a plurality of nozzle holes for injecting the liquid are arranged in the form of a line;

displacement transmission members each having one end thereof connected to an end portion of said nozzle plate to support the end portion in a direction parallel to a direction in which said plurality of nozzle holes are arranged; and actuators, arranged to be in contact with respective other ends of said displacement transmission members, for displacing said nozzle plate connected to the one ends of said displacement transmission members via said displacement transmission members such that pressure is applied to the liquid in said pressure chamber, thereby forcing the liquid in said pressure chamber from said nozzle holes.

9. A liquid injection apparatus according to claim 1, wherein said actuator is a piezoelectric element.

10. A liquid injection apparatus according to claim 1, wherein said actuator comprises a plurality of actuating elements.

11. A liquid injection apparatus according to claim 1, wherein said elastic member consists of a thin rubber membrane.

12. A liquid injection apparatus according to claim 1, further comprising an elastic adhesive which buries a gap between the wall portion of said pressure chamber and said elastic member to seal the gap of said pressure chamber.

13. A liquid injection apparatus according to claim 1, further comprising a displacement transmission member which has one end portion connected to an end portion of said nozzle plate to support the end portions of the nozzle plate in a direction parallel to a direction in which said plurality of nozzle holes are arranged;

wherein said actuator is arranged to be in contact with the other end portion of said displacement transmission member, and displaces said nozzle plate connected to said one end portion of said displacement transmission member through said displacement transmission member.

14. A liquid injection apparatus according to claim 13, further comprising a support member which is arranged between said one end portion of said displacement transmission member and said other end portion of said displacement transmission member to support said displacement transmission member in such a manner that, when said other end portion of said displacement transmission member is moved by said actuator, said one end portion of said displacement transmission member moves in a direction opposing a direction in which said other end portion moves.

15. A liquid injection apparatus according to claim 1, wherein said actuator is fixed on said nozzle plate on both sides of a portion of said nozzle plate where said nozzle holes are arranged.

16. A liquid injection apparatus according to claim 15, wherein said actuator is fixed on said nozzle plate by an adhesive.

17. A liquid injection apparatus according to claim 15, wherein said actuator has a rectangular parallelpiped shape, and is fixed on said nozzle plate in such a manner that a longitudinal axis of said actuator is perpendicular to a direction in which said nozzle holes are arranged.

18. A liquid injection apparatus according to claim 15, wherein said actuator comprises a plurality of actuating elements which are symmetrically arranged using the arrangement of said nozzle holes as a central axis.

19. A liquid injection apparatus according to claim 15, wherein said nozzle plate forms an upper surface of said pressure chamber, and said nozzle holes are arranged on a central axis in the longitudinal direction of said nozzle plate, and wherein said nozzle plate is displaced by said actuator so that the central axis, in the longitudinal direction of said nozzle plate in which said nozzle holes are arranged, is downwardly displaced.

20. A liquid injection apparatus according to claim 10, further comprising a controller which simultaneously operates said plurality of actuating elements.

* * * * *